US011668116B2

(12) United States Patent
Chen et al.

(10) Patent No.: US 11,668,116 B2
(45) Date of Patent: Jun. 6, 2023

(54) DOOR HANDLE SET HAVING A SUPPLEMENTAL CHILD-RESISTANT LOCK

(71) Applicant: DORMAKABA USA INC., Indianapolis, IN (US)

(72) Inventors: (Steven) Ming-Che Chen, Chiayi (TW); (Sam Chen) Po-Yang Chen, Chiayi (TW); (Newman Lai) Cheng-Wen Lai Lai, Chiayi (TW); (Kate) Kai-Ting Tung, Chiayi (TW); Justin Crotzer, Indianapolis, IN (US); Brandon Faulkner, Bargersville, IN (US)

(73) Assignee: dormakaba USA Inc., Indianapolis, IN (US)

( * ) Notice: Subject to any disclaimer, the term of this patent is extended or adjusted under 35 U.S.C. 154(b) by 474 days.

(21) Appl. No.: 16/466,220

(22) PCT Filed: Dec. 5, 2017

(86) PCT No.: PCT/US2017/064785
§ 371 (c)(1),
(2) Date: Jun. 3, 2019

(87) PCT Pub. No.: WO2018/106739
PCT Pub. Date: Jun. 14, 2018

(65) Prior Publication Data

US 2020/0063464 A1 Feb. 27, 2020

Related U.S. Application Data

(63) Continuation-in-part of application No. PCT/US2016/065948, filed on Dec. 9, 2016.

(51) Int. Cl.
*E05B 13/10* (2006.01)
*E05B 65/00* (2006.01)
(Continued)

(52) U.S. Cl.
CPC ..... *E05B 13/108* (2013.01); *E05B 13/004* (2013.01); *E05B 13/10* (2013.01);
(Continued)

(58) Field of Classification Search
CPC ..... E05B 13/002; E05B 13/004; E05B 13/10; E05B 13/106; E05B 13/108;
(Continued)

(56) References Cited

U.S. PATENT DOCUMENTS 2,289,834 A * 7/1942 Goldberg ..... E05B 13/004 292/359
2,316,493 A * 4/1943 Roy ..... E05B 13/004 292/359
(Continued)

FOREIGN PATENT DOCUMENTS

TW 306541 U 5/1997

OTHER PUBLICATIONS

International Preliminary Report on Patentability received for PCT Patent Application No. PCT/US2016/065948, dated Aug. 29, 2019, 8 pages.
(Continued)

*Primary Examiner* — Christopher J Boswell
(74) *Attorney, Agent, or Firm* — Faegre Drinker Biddle & Reath LLP

(57) ABSTRACT

A door handle set includes a handle assembly having a primary lock and having a handle rotatable about a primary rotational axis. A latch bolt assembly has a latch bolt. The latch bolt assembly is operatively coupled to the handle assembly, wherein a rotation of the handle results in a linear translation of the latch bolt. A supplemental lock has a second axis parallel to, and spaced apart from, the primary rotational axis. The supplemental lock has an actuator that is operable relative to the second axis. The supplemental lock
(Continued)

is configured to selectively block the rotation of the handle regardless of the locking state of the primary lock.

20 Claims, 7 Drawing Sheets

(51) Int. Cl.
*E05B 13/00* (2006.01)
*E05B 17/20* (2006.01)
*E05B 55/00* (2006.01)

(52) U.S. Cl.
CPC ..... *E05B 17/2034* (2013.01); *E05B 55/005* (2013.01); *E05B 65/0014* (2013.01)

(58) Field of Classification Search
CPC ..... E05B 17/2007; E05B 17/203; E05B 17/2034; E05B 17/2053; E05B 17/2069; E05B 17/2073; E05B 65/0014
See application file for complete search history.

(56) References Cited

U.S. PATENT DOCUMENTS 3,741,619 A 6/1973 Dyer et al.
4,861,084 A * 8/1989 Ozagir ..... E05B 13/004 292/359
5,083,823 A 1/1992 Fann et al.
5,284,372 A 2/1994 Lin
5,286,074 A * 2/1994 Lin ..... E05B 13/002 292/150
5,505,508 A * 4/1996 Kuo ..... E05B 13/004 292/169.17
5,562,317 A * 10/1996 Kuo ..... E05B 13/002 292/359
5,784,909 A 7/1998 Huang
5,826,924 A * 10/1998 Huang ..... E05B 13/004 292/359
5,832,758 A 11/1998 White
6,264,255 B1 7/2001 Fortune
6,568,231 B1 * 5/2003 Huang ..... E05B 13/004 292/358
6,644,077 B1 11/2003 Huang
6,735,993 B2 5/2004 Eller et al.
6,929,292 B1 8/2005 Galindo et al.
7,334,824 B2 2/2008 Sundberg et al.
7,387,005 B2 * 6/2008 Huang ..... E05B 65/0035 292/336.3
2005/0046203 A1 3/2005 Huang
2013/0125389 A1 5/2013 Vanhellemont
2015/0048626 A1 2/2015 Hogan
2015/0107314 A1 4/2015 Le

OTHER PUBLICATIONS

International Preliminary Report on Patentability received for PCT Patent Application No. PCT/US2017/064785, dated Jun. 20, 2019, 7 pages.
International Search Report and Written Opinion received for PCT Patent Application No. PCT/US2016/065948, dated Jun. 6, 2017, 8 pages.
International Search Report and Written Opinion received for PCT Patent Application No. PCT/US2017/064785, dated Feb. 14, 2018, 7 pages.

* cited by examiner

DOOR HANDLE SET HAVING A SUPPLEMENTAL CHILD-RESISTANT LOCK

CROSS-REFERENCE TO RELATED APPLICATIONS

This application to is a U.S. National Phase Patent Application based on International Application No. PCT/US2017/064785. Filed on Dec. 5, 2017, which is a Continuation in part of International Application No. PCT/US2016/065948, filed on Dec. 9, 2016, the entire disclosures which are expressly incorporated by reference herein.

TECHNICAL FIELD

The present invention relates to a door lock, and, more particularly, to a locking door handle set having a supplemental child-resistant lock.

BACKGROUND ART

A typical door handle set includes a latch bolt assembly and a latch bolt lock. The interior handle often includes an axial turn button or push button on the interior side of the door to operate the latch bolt lock. In some designs, the latch bolt assembly may be unlocked from the inside of the door by simply rotating the interior door lever/knob. It has been observed that a child, such as a toddler, may have the dexterity to actuate the interior lock button or rotate the interior door lever/knob, thus unlocking the door and permitting the child to leave the room unbeknownst to the supervising adult, such as the child's parent.

Another type of lock is disclosed in GB 1279989, wherein the door lock has a vertical slider member that is located in plain view and is movable up and down to selectively engage a notch in a disc that cooperates with a latch part. However, with the slider member being in plain view to a child of toddler size, the child may still be able to easily unlock the door.

What is needed in the art is a door handle set having a child-resistant lock that may be used to supplement the primary lock of the door handle set.

SUMMARY OF INVENTION

The present invention provides a door handle set having a child-resistant lock that may be used to supplement the primary lock of the door handle set.

The invention in one form is directed to a door handle set that includes a handle assembly having a primary lock and having a handle rotatable about a primary rotational axis. A latch bolt assembly has a latch bolt. The latch bolt assembly is operatively coupled to the handle assembly, wherein a rotation of the handle results in a linear translation of the latch bolt. A supplemental lock has a second axis parallel to, and spaced apart from, the primary rotational axis. The supplemental lock has an actuator that is operable relative to the second axis. The supplemental lock is configured to selectively block the rotation of the handle regardless of the locking state of the primary lock.

The invention in another form is directed to a door handle set that includes a handle assembly having a chassis, a primary lock, and a handle rotatably coupled to the chassis. The handle is rotatable about a primary rotational axis. The primary lock is arranged along the primary rotational axis. A latch bolt assembly has a latch bolt. The latch bolt assembly is operatively coupled to the handle assembly, wherein a rotation of the handle results in a linear translation of the latch bolt. A supplemental lock has a translation axis that is substantially orthogonal to the primary rotational axis. The supplemental lock has an actuator that is operable relative to the translation axis, wherein the supplemental lock is configured to selectively block the rotation of the handle regardless of the locking state of the primary lock.

An advantage of the present invention is that the supplemental (child-resistant) lock may be operated easily by an adult from inside and/or outside of the door, but a child may not be able to easily understand and operate the lock, so as to prevent the child from going outside unsupervised while the supervising adult, e.g., parents and/or family member, is unaware.

Another advantage is that the supplemental (child-resistant) lock operates as a "safe pass mechanism", which prevents the door from being opened by rotating the door lever directly to unlock the primary lock.

Yet another advantage, in one embodiment, is that an adult may lock and unlock the supplemental lock from inside or outside of the door, but the supplemental lock does not affect the original function of the primary door lock.

Yet another advantage is that in an emergency situation, an adult can overcome the secondary locking provided by the supplemental (child-resistant) lock by forcefully and directly rotating the door lever/knob.

BRIEF DESCRIPTION OF DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DESCRIPTION OF EMBODIMENTS

Figure 1:
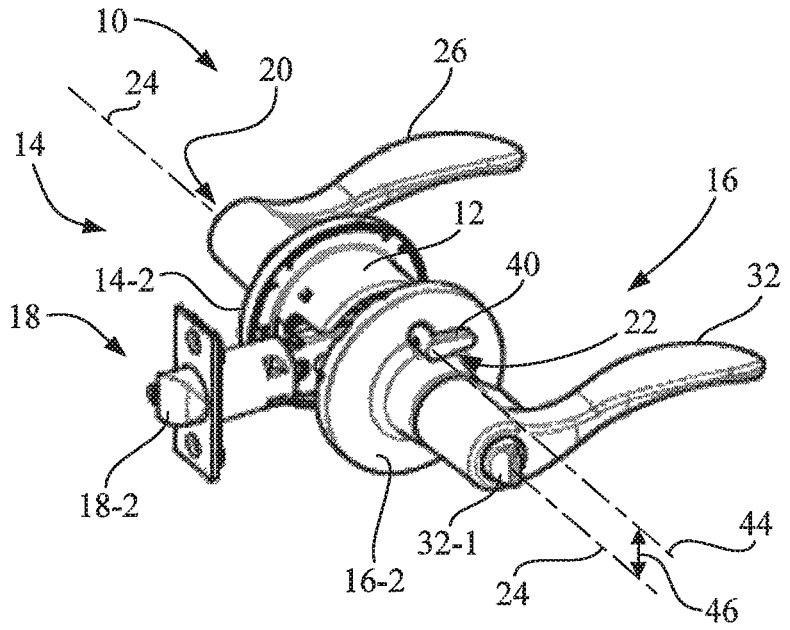
FIG. 1 is a perspective view of a handle set having a supplemental lock, in accordance with an embodiment of the present invention.
Figure 2:
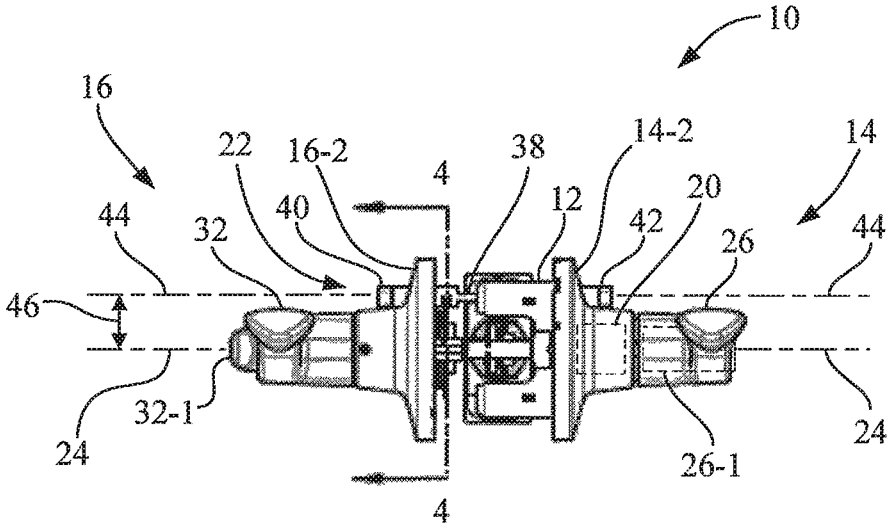
FIG. 2 is a side view of the handle set of FIG. 1 that shows a portion of a supplemental lock, and depicts a primary lock and key cylinder by dashed lines.

Referring now to the drawings and particularly to FIGS. 1 and 2, there is shown a handle set 10 embodying the present invention. Handle set 10 includes a mounting body 12, an exterior handle assembly 14, an interior handle assembly 16, a latch bolt assembly 18, a primary lock 20, and a supplemental (child-resistant) lock 22. Mounting body 12, exterior handle assembly 14, interior handle assembly 16, and primary lock 20 are oriented and arranged along a primary rotational axis 24.

Mounting body 12 may be, for example, a cast metal article, and configured for mounting to a door. As such, mounting body 12 serves as a mounting location for exterior handle assembly 14 and interior handle assembly 16, with the chassis being inserted into a face bore that extends from the interior face to the exterior face of the door (not shown), and with the thickness of the door positioned between exterior handle assembly 14 and interior handle assembly 16.

Latch bolt assembly 18 includes a housing 18-1, a latch bolt 18-2, and a latch bolt drive 18-3. Latch bolt 18-2 is slidably received in housing 18-1, and is movable between an extended position and a retracted position. Latch bolt drive 18-3 is rotatable relative to housing 18-1, and is operatively coupled to latch bolt 18-2. Latch bolt drive 18-3 is configured to convert a rotary input into a linear translation of latch bolt 18-2.

Figure 3:
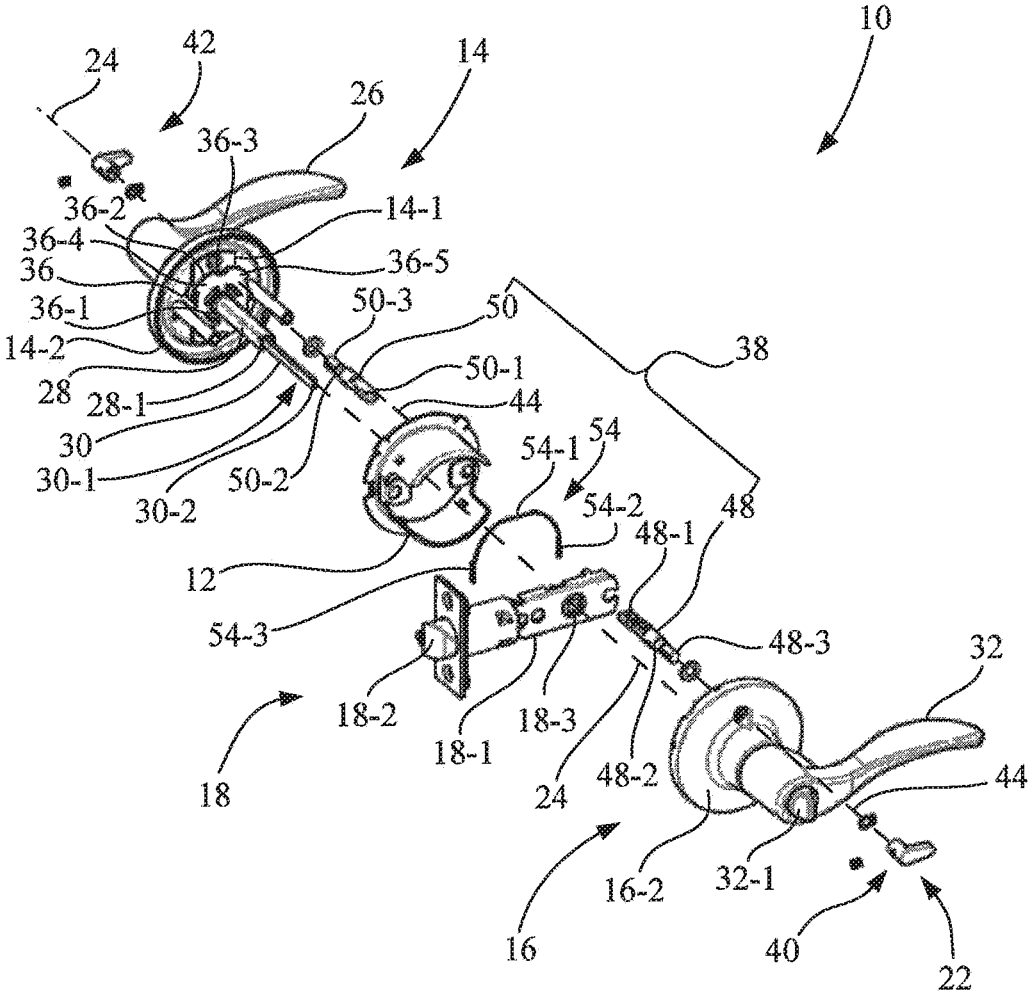
FIG. 3 is an exploded view of the handle set of FIGS. 1 and 2.

Referring also to FIG. 3, exterior handle assembly 14 includes an exterior chassis 14-1, an exterior escutcheon 14-2, and an exterior handle 26, e.g., a knob or lever. Exterior handle 26 is rotatably coupled to an exterior chassis 14-1, and is positioned to rotate about primary rotational axis 24. Exterior handle 26 includes a key cylinder 26-1 that is contained in exterior handle 26, with key cylinder 26-1 having a key opening that is accessible from an exterior of exterior handle 26. Key cylinder 26-1 is rotatable along primary rotational axis 24. Key cylinder 26-1 of exterior handle 26 is operatively coupled to primary lock 20, as is known in the art.

A latch spindle 28 is operatively coupled to exterior handle 26, and extends from exterior handle assembly 14 toward interior handle assembly 16 along primary rotational axis 24. Latch spindle 28 is a hollow elongate shaft, and has a rectangular exterior perimeter for drivably engaging latch bolt drive 18-3 of latch bolt assembly 18. Latch spindle 28 has a distal end 28-1 that extends through latch bolt assembly 18, with distal end 28-1 of latch spindle 28 being operatively coupled to interior handle assembly 16. A rotation of exterior handle 26 results in a linear translation of latch bolt 18-2 via a corresponding rotation of latch spindle 28.

In the present embodiment, primary lock 20 is contained in exterior handle assembly 14. Primary lock 20 has a locked state that prohibits rotation of latch spindle 28, at least by exterior handle 26, and has an unlocked state that permits rotation of latch spindle 28. Primary lock 20 is operable from outside the door via key cylinder 26-1, which is located in exterior handle 26 of exterior handle assembly 14. Primary lock 20 may be a "decoupling" type of lock wherein exterior handle 26 is decoupled from latch spindle 28 when in the locked state, or may be a "blocking" type of lock that prevents exterior handle 26 from rotating when in the locked state.

As shown in FIG. 3, locking spindle 30 is positioned in an elongate opening defined by the hollow latch spindle 28, with locking spindle 30 being rotatable in latch spindle 28. A proximal end portion of locking spindle 30 is operatively coupled to primary lock 20. Locking spindle 30 has a distal portion 30-1 with a distal end 30-2, which axially extends along primary rotational axis 24 from distal end 28-1 of latch spindle 28. Distal portion 30-1 of locking spindle 30 is operatively coupled to interior handle assembly 16.

Figure 4:
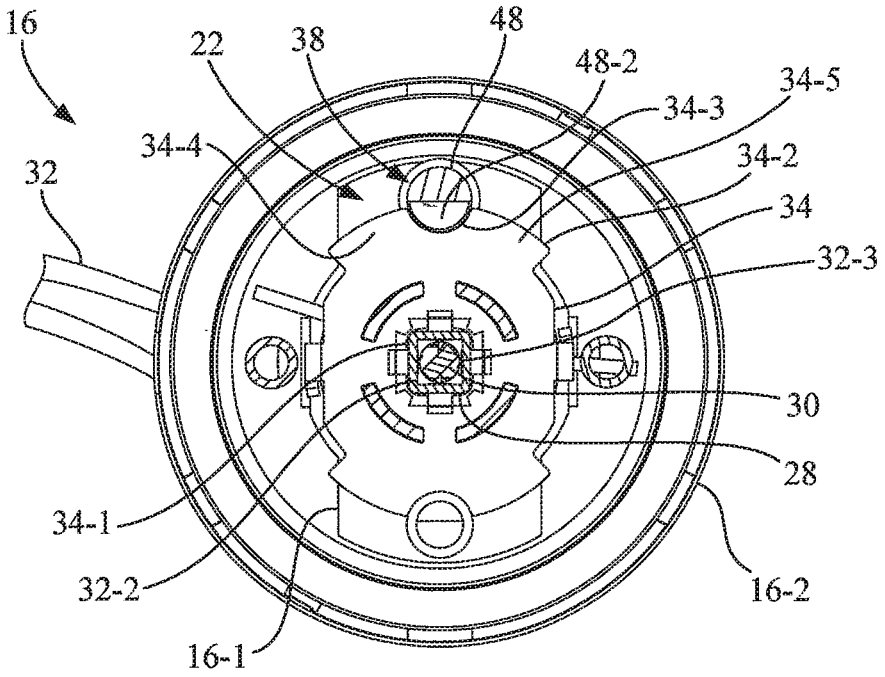
FIG. 4 is a section view of the interior handle assembly of the handle set of FIGS. 1 and 2 taken along line 4-4 of FIG. 2, and showing the interior rotation plate and the rotation rod of the supplemental lock in the non-blocking position.
Figure 5:
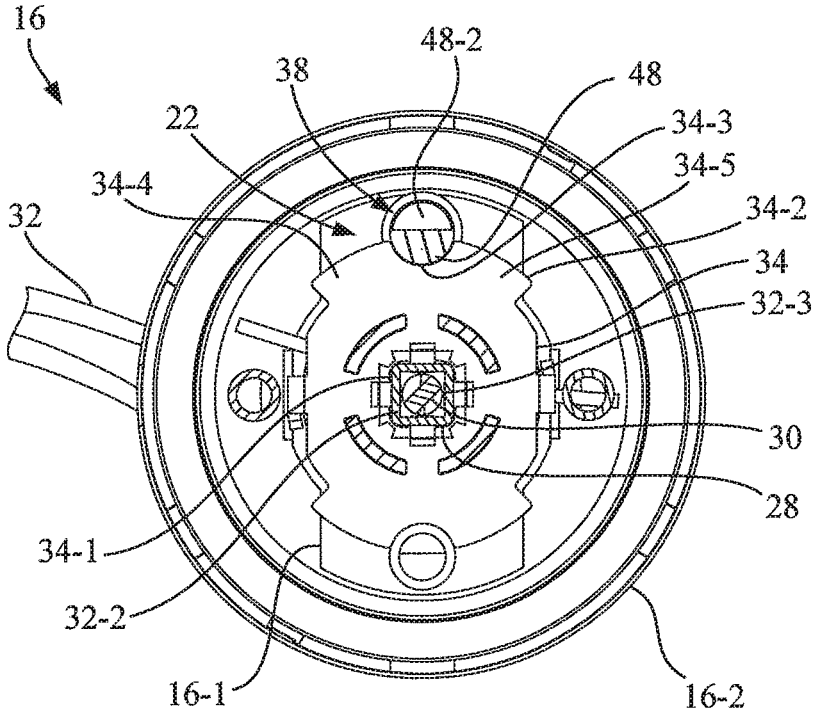
FIG. 5 is a section view corresponding to the section view of FIG. 4, with the rotation rod of the supplemental lock rotated to the blocking position.

In particular, referring also to FIGS. 4 and 5, interior handle assembly 16 includes an interior chassis 16-1, an interior escutcheon 16-2, and an interior handle 32, e.g., a knob or lever. Interior handle 32 is rotatably coupled to an interior chassis 16-1, and is positioned to rotate about primary rotational axis 24. Interior handle 32 has an interior primary lock turn button 32-1 that is rotatably connected to interior handle 32 for rotation about primary rotational axis 24. Interior primary lock turn button 32-1 extends from an exterior of interior handle 32 along primary rotational axis 24 so as to be accessible from an interior of the door.

Referring also to FIGS. 4 and 5, interior handle 32 has a spindle drive opening 32-2 configured to receive distal end 28-1 of latch spindle 28, so as to facilitate operation of latch bolt assembly 18 using interior handle 32. A rotation of interior handle 32 results in a linear translation of latch bolt 18-2 via a corresponding rotation of latch spindle 28.

Also, interior primary lock turn button 32-1 is operatively coupled to primary lock 20. In particular, interior primary lock turn button 32-1 has a locking spindle drive opening 32-3 configured to receive distal end 30-2 of locking spindle 30, so as to facilitate operation of primary lock 20 from interior handle 32.

Referring to FIGS. 3-5, in accordance with the present embodiment, the child-resistant supplemental lock 22 includes a first rotation plate 34, a second rotation plate 36, a rotation rod 38, an interior actuator 40, and an exterior actuator 42. Each of rotation rod 38, interior actuator 40, and exterior actuator 42 is located for rotation about a secondary rotational axis 44. Supplemental lock 22 is configured to selectively block the rotation of the handle, e.g., interior handle 32, which operates latch bolt assembly 18, regardless of the locking state of primary lock.

In the present embodiment, secondary rotational axis 44 is parallel to, and radially spaced from, primary rotational axis 24, such that, from a perspective of a small child, e.g., a toddler, a visual location of interior actuator 40 will be obscured by the presence of interior handle 32. Stated differently, interior actuator 40 is positioned to be visually obscured by interior handle 32 when viewed at an angle originating below primary rotational axis 24. Likewise, exterior actuator 42 is positioned to be visually obscured by exterior handle 26 when viewed at an angle originating below primary rotational axis 24.

Referring also to FIG. 2, in the present embodiment, secondary rotational axis 44 is vertically spaced from primary rotational axis 24 by a distance 46, so as to position interior actuator 40 immediately above interior handle 32, and to position exterior actuator 42 immediately above external handle 26. As used herein, the term "immediately above" is a location juxtaposed to the component of reference, with "juxtaposed" being a range of 3.0 to 15 millimeters, and wherein distance 46 is selected to achieve the juxtaposed relationship.

As best shown in FIG. 3, in the present embodiment, rotation rod 38 is a two-part structure, having a first rotation rod portion 48 and a second rotation rod portion 50. First rotation rod portion 48 has a coupling tail 48-1. Second rotation rod portion 50 has a coupling groove 50-1 for slidably receiving of coupling tail 48-1 of first rotation rod portion 48 along secondary rotational axis 44. First rotation rod portion 48 is rotatably coupled to interior chassis 16-1, and second rotation rod portion 50 is rotatably coupled to exterior chassis 14-1.

Referring to FIGS. 3-5, first rotation rod portion 48 includes an outer radial slot 48-2 that extends partway into first rotation rod portion 48, e.g., halfway through first rotation rod portion 48 to secondary rotational axis 44. Outer radial slot 48-2 is axially positioned along secondary rotational axis 44 to radially receive first rotation plate 34. First rotation rod portion 48 has a proximal end 48-3 which extends outwardly through a hole in interior escutcheon 16-2, with interior actuator 40, e.g., an operating lever, being connected to proximal end 48-3, e.g., via a set screw. A rotation of interior actuator 40 about secondary rotational axis 44 results in a corresponding rotation of first rotation rod portion 48, and in turn, a corresponding rotation of second rotation rod portion 50.

Likewise, second rotation rod portion 50 has an outer radial slot 50-2 that extends partway into second rotation rod portion 50, e.g., halfway through second rotation rod portion 50 to secondary rotational axis 44. Outer radial slot 50-2 is axially positioned along secondary rotational axis 44 to radially receive second rotation plate 36. Second rotation rod portion 50 has a proximal end 50-3 which extends outwardly through a hole in exterior escutcheon 14-2, with exterior actuator 42, e.g., an operating lever, being connected to proximal end 50-3, e.g., via a set screw. A rotation of exterior actuator 42 about secondary rotational axis 44 results in a corresponding rotation of second rotation rod portion 50, and in turn, a corresponding rotation of first rotation rod portion 48.

As depicted in FIGS. 4 and 5, first rotation plate 34 includes an opening 34-1 to receive latch spindle 28. Referring also to FIG. 3, first rotation plate 34 is configured for connection to latch spindle 28, such that first rotation plate 34 rotates in unison with latch spindle 28 about primary rotational axis 24. Likewise, as depicted in FIG. 3, second rotation plate 36 includes an opening 36-1 to receive latch spindle 28. Second rotation plate 36 is connected to latch spindle 28, such that second rotation plate 36 rotates in unison with latch spindle 28 about primary rotational axis 24.

FIGS. 3-5 show interior handle 32 in the home position, wherein the latch bolt 18-2 of latch bolt assembly 18 is in an extended position. Referring to FIGS. 4 and 5, first rotation plate 34 has an outer perimeter 34-2 that defines a radially inwardly facing notch 34-3 that is interposed between two locking projections 34-4, 34-5. Radially inwardly facing notch 34-3 is sized and positioned to accommodate the diameter of first rotation rod portion 48 of rotation rod 38.

When outer radial slot 48-2 of first rotation rod portion 48 is in a non-blocking position, as depicted in FIG. 4, outer radial slot 48-2 is rotatably positioned to receive, and thus accommodate, rotation of locking projections 34-4 and/or 34-5 of first rotation plate 34. In other words, rotation of the locking projections 34-4 and/or 34-5 of first rotation plate 34, and in turn interior handle 32, as well as exterior handle 26, is not impeded from rotation about primary rotational axis 24, thereby permitting operation of latch bolt 18-2.

However, by rotating interior actuator 40, and in turn first rotation rod portion 48, by a predetermined amount, e.g., 90 to 270 degrees, first rotation rod portion 48 is rotatably positioned in a blocking position, as depicted in FIG. 5, wherein outer radial slot 48-2 is no longer rotatably positioned to receive a rotation of first rotation plate 34. In other words, when first rotation rod portion 48 is rotated to the blocking position, outer radial slot 48-2 is positioned such that at least one of the pair of locking projections 34-4, 34-5 of first rotation plate 34 will engage first rotation rod portion 48, so as to block rotation of first rotation plate 34 and interior handle 32, and in turn prevent retraction of latch bolt 18-2. Thus, first rotation rod portion 48 blocks rotation of first rotation plate 34 and in turn blocks rotation of interior handle 32, as well as exterior handle 26, so as to impede retraction of latch bolt 18-2.

FIG. 3 shows exterior handle 26 in the home position, wherein the latch bolt 18-2 of latch bolt assembly 18 is in an extended position. Second rotation plate 36 has an outer perimeter 36-2 that defines a radially inwardly facing notch 36-3 that is interposed between two locking projections 36-4, 36-5. Radially inwardly facing notch 36-3 is sized and positioned to accommodate the diameter of second rotation rod portion 50 of rotation rod 38.

When outer radial slot 50-2 of second rotation rod portion 50 is in a non-blocking position, outer radial slot 50-2 is rotatably positioned to receive, and thus accommodate, a rotation of the locking projections 36-4 and/or 36-5 of second rotation plate 36. In other words, rotation of second rotation plate 36, and in turn exterior handle 26, as well as interior handle 32, is not impeded from rotation about primary rotational axis 24, thereby permitting operation of latch bolt 18-2.

However, by rotating exterior actuator 42, and in turn second rotation rod portion 50, by a predetermined amount, e.g., 90 to 270 degrees, second rotation rod portion 50 is rotatably positioned in a blocking position, and outer radial slot 50-2 is no longer rotatably positioned to receive a rotation of second rotation plate 36. In other words, when second rotation rod portion 50 is rotated to a blocking position, outer radial slot 50-2 is positioned such that at least one of the pair of locking projections 36-4, 36-5 of second rotation plate 36 will engage second rotation rod portion 50, so as to block rotation of second rotation plate 36 and exterior handle 26, and in turn prevent retraction of latch bolt 18-2. Thus, second rotation rod portion 50 blocks rotation of second rotation plate 36, and in turn blocks rotation of exterior handle 26, as well as interior handle 32, so as to prevent retraction of latch bolt 18-2.

Thus, even if primary lock 20 is unlocked by the rotation of interior primary lock turn button 32-1 or interior handle 32, so long as supplemental lock 22, and in particular, rotation rod 38, e.g., first rotation rod portion 48 and second rotation rod portion 50, is in the blocking position, rotation of interior handle 32 and exterior handle 26 is impeded, and latch bolt 18-2 is impeded from rotation to open the door.

Notwithstanding, in an emergency situation, application of sufficient force to interior handle 32 will cause interior handle 32 to rotate latch spindle 28, first rotation plate 34, and second rotation plate 36, thereby causing component failure in supplemental lock 22, such that a rotation of interior handle 32 will operate latch bolt 18-2. Such component failure may be in the form of a component deflection and/or breaking of first rotation plate 34, second rotation plate 36, and rotation rod 38. In one implementation, at least one of first and second rotation plates 34, 36, and rotation rod 38 may be made of plastic, or a soft metal such as aluminum, so as to facilitate component failure in an emergency situation.

While the present embodiment of supplemental lock 22 is described as including two rotation plates, e.g., first rotation plate 34 and second rotation plate 36, those skilled in the art will recognize that the present invention may be practiced by using a single rotation plate, e.g., first rotation plate 34. Also, in an application where no external actuation of supplemental lock 22 is desired, it is contemplated that exterior actuator 42, second rotation rod portion 50 of rotation rod 38, and second rotation plate 36 may be optional, and eliminated from the design.

Figure 6:
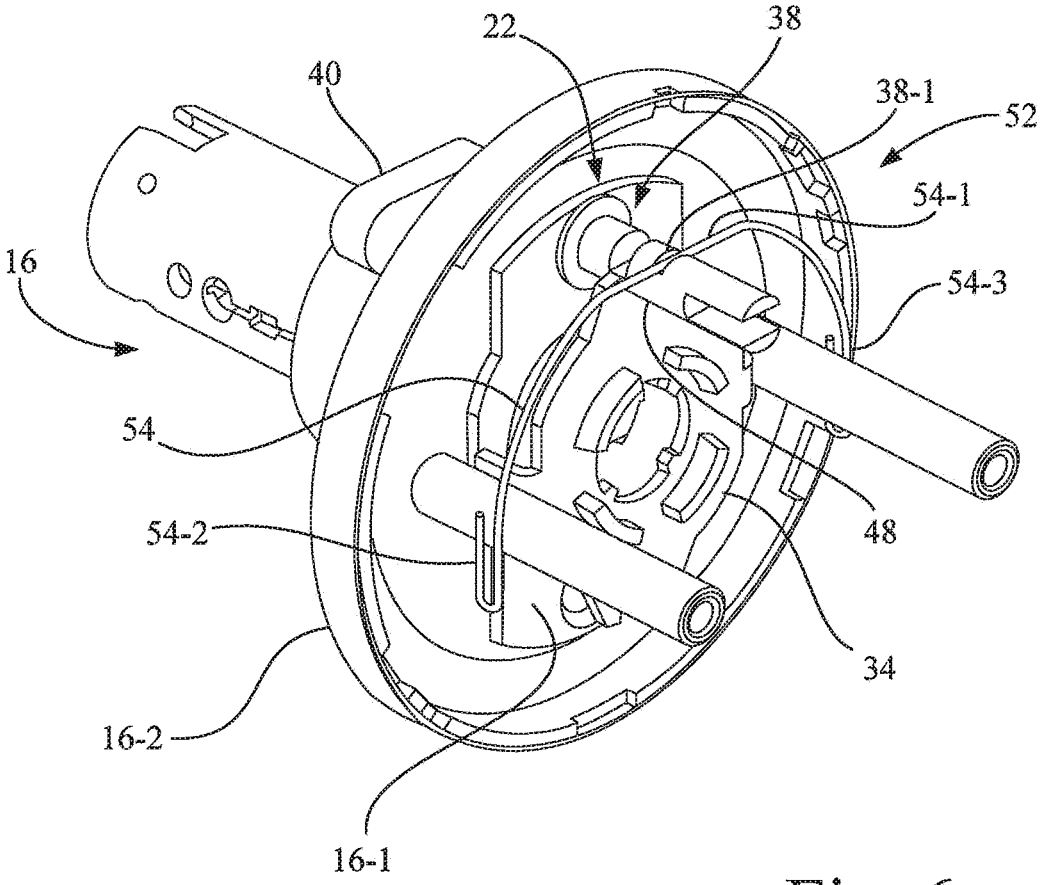
FIG. 6 is a rear perspective view of the interior handle assembly of the handle set of FIGS. 1 and 2, showing the detent mechanism of the supplemental lock.

Referring to FIGS. 3 and 6, supplemental lock 22 may include a detent mechanism 52 that is associated with rotation rod 38, such that in each of the blocking and non-blocking orientations, detent mechanism 52 provides detent functionality which provides a degree of resistance to the rotation of the rotatable actuator, i.e., interior actuator 40 and/or exterior actuator 42. In particular, detent mechanism 52 includes a detent groove 38-1, e.g., a recessed flat, which is located on rotation rod 38, and a spring member 54. In operation, spring member 54 of detent mechanism 52 is configured to continuously exert a radial force on rotation rod 38.

In the present embodiment, spring member 54 is a wire spring having a downwardly facing U-shape that includes a substantially horizontal engagement portion 54-1, and two free end portions 54-2, 54-3 that are respectively connected to the handle chassis, e.g., interior chassis 16-1. Engagement portion 54-1 of spring member 54 is positioned to engage and disengage detent groove 38-1 as rotation rod 38 is rotated, with spring member 54 providing a continuous force against rotation rod 38.

More particularly, engagement portion 54-1 of spring member 54 is positioned to be in radial alignment with detent groove 38-1 so as to engage detent groove 38-1 when detent groove 38-1 of rotation rod 38 is rotated to facilitate engagement with spring member 54. For example, when rotation rod 38 is in the blocked position, engagement portion 54-1 of wire spring member 54 is positioned in detent groove 38-1 of rotation rod 38, to resist rotation of rotation rod 38. However, when sufficient rotational force is applied to rotation rod 38 to overcome the force exerted by spring member 54, then rotation rod 38 is rotated from the blocked position toward the non-blocked position, wherein spring member 54 will ride out of detent groove 38-1 of rotation rod 38, and onto an exterior of rotation rod 38.

Thus, with the present invention, the "child-resistant" functionality is provided by providing supplemental lock 22 that provides locking redundancy, and wherein the actuator, e.g., interior actuator 40, is located so as not to be readily visible to the small child, e.g., a toddler. Also, the "child-resistant" functionality may be further enhanced by the inclusion of detent mechanism 52 to provide detent functionality, which, provides a degree of resistance to the turning of the actuator, e.g., interior actuator 40.

Figure 7:
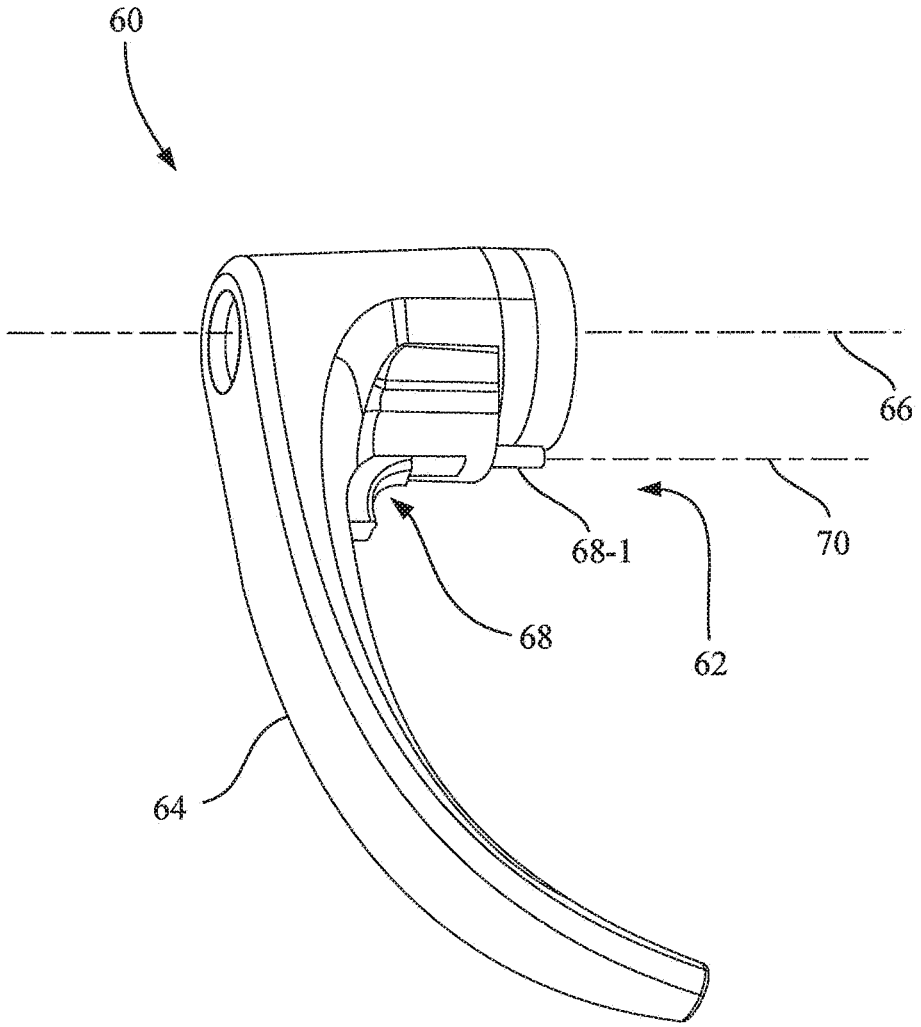
FIG. 7 is a perspective view of an interior handle in accordance with another embodiment of the invention, and showing an alternative supplemental lock.
Figure 8:
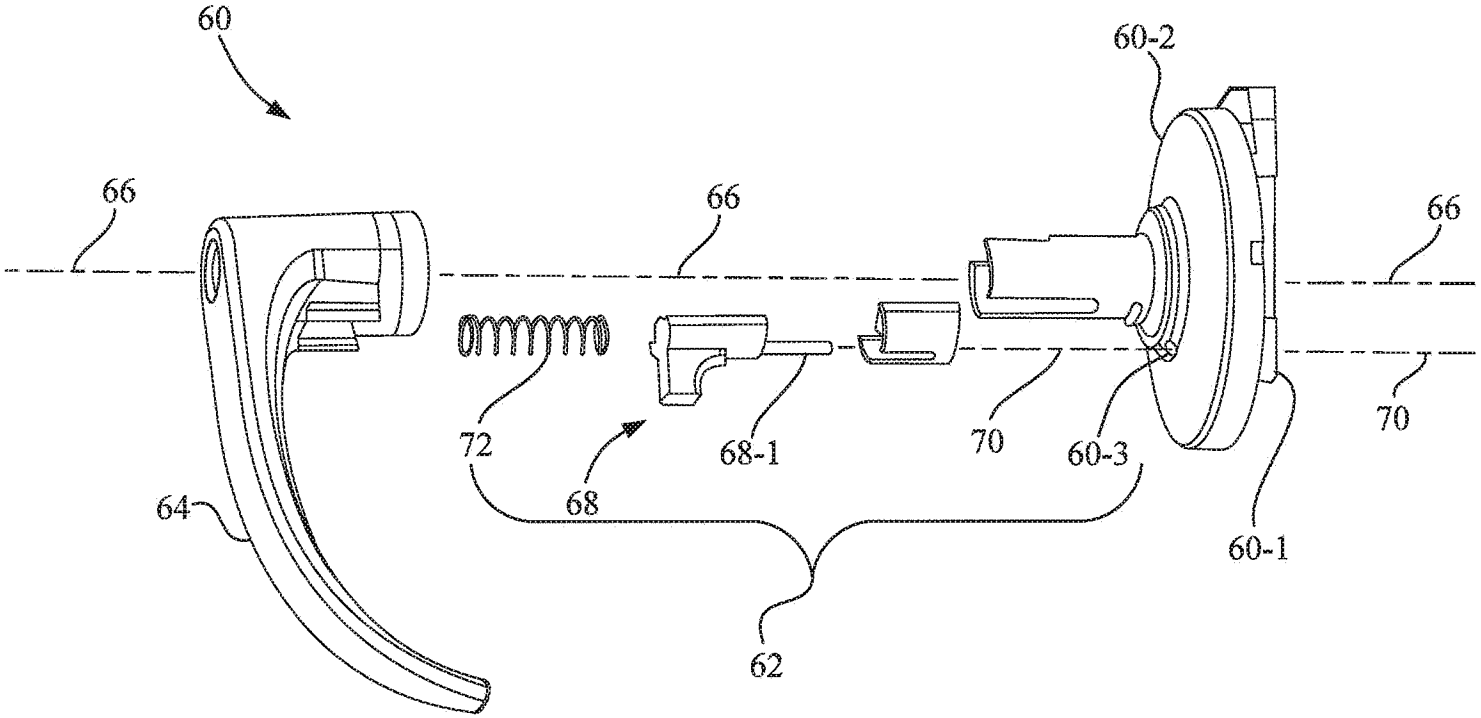
FIG. 8 is an exploded view of an interior handle assembly that incorporates the interior handle of FIG. 7, and showing the alternative supplemental lock.

FIGS. 7 and 8 depict another embodiment of the invention. The present embodiment of FIGS. 7 and 8 differs from the embodiment of FIGS. 1-6, in significant part, by using axial motion rather than rotary motion to selectively block and unblock rotation of the interior handle, and by the lack of the rotation plate(s) of the embodiment of FIGS. 1-6.

In particular, the present alternative embodiment includes an interior handle assembly 60, and includes a supplemental lock 62 that is supplemental to primary lock 20 (not shown; see, e.g., FIG. 2). Interior handle assembly 60 is configured for coupling to latch bolt assembly 18 via latch spindle 28 as in the prior embodiment (not shown; see, e.g., FIG. 3). Interior handle assembly 60 includes an interior chassis 60-1, an interior escutcheon 60-2, and an interior handle 64, e.g., a lever. Interior handle 64 is rotatably coupled to an interior chassis 60-1, and is positioned to rotate about a primary rotational axis 66. Interior handle 64 is coupled to latch spindle 28 for rotation in unison therewith. A rotation of interior handle 64 results in a linear translation of latch bolt 18-2 via a corresponding rotation of latch spindle 28.

Supplemental lock 62 is configured to selectively block the rotation of the handle, e.g., interior handle 64, which operates latch bolt assembly 18, regardless of the locking state of the primary lock, e.g., primary lock 20 depicted in FIG. 2.

Interior handle 64 slidably mounts an interior actuator 68 of supplemental lock 62, which is in the form of a pull trigger, and which is configured to translate linearly along a secondary axis 70. Secondary axis 70 is radially offset from primary rotational axis 66. Interior actuator 68 may be formed from a polymer, e.g., plastic, material. In the present embodiment, interior actuator 68 is obscured by the radial interior handle 64, and in addition, a rotation of interior handle 64 requires operation (linear translation) of interior actuator 68, thereby providing child-resistant functionality, such that interior actuator 68 is pulled and held while rotating interior handle 64.

Referring to FIG. 8, interior actuator 68 includes a projecting rod 68-1 that linearly moves along secondary axis 70. Projecting rod 68-1 is axially aligned with a hole 60-3 located in interior escutcheon 60-2, such that projecting rod 68-1 selectively extends along secondary axis 70 and into the hole 60-3 of interior escutcheon 60-2. Interior actuator 68 is biased toward interior escutcheon 60-2 by a spring member 72, which in the present embodiment is in the form of a coil spring. Supplemental lock 62 may be disabled by rotating interior escutcheon 60-2, such that projecting rod 68-1 is no longer aligned with hole 60-3 in interior escutcheon 60-2.

Thus, in the blocking position, projecting rod 68-1 of interior actuator 68 will extend into hole 60-3 in interior escutcheon 60-2, so as to thereby block rotation of interior handle 64. Supplemental lock 62 is repositioned to a non-blocking position by linearly moving interior actuator 68 in a direction away from interior escutcheon 60-2 to thereby disengage projecting rod 68-1 from hole 60-3 of interior escutcheon 60-2, so as to unblock the rotation of interior handle 64. The linear movement of interior actuator 68 may be effected, for example, by retracting (e.g., pulling) interior actuator 68 and projecting rod 68-1 along secondary axis 70, to thereby disengage projecting rod 68-1 from hole 60-3 of interior escutcheon 60-2. Supplemental lock 62 may be disabled by rotating interior escutcheon 60-2, such that projecting rod 68-1 is no longer axially aligned with hole 60-3 in interior escutcheon 60-2.

In an emergency situation, if enough force is applied to interior handle 64, then projecting rod 68-1 will be broken, i.e., sheared, by engagement with interior escutcheon 60-2 at hole 60-3, thereby allowing free rotation of interior handle 64.

Figure 9:
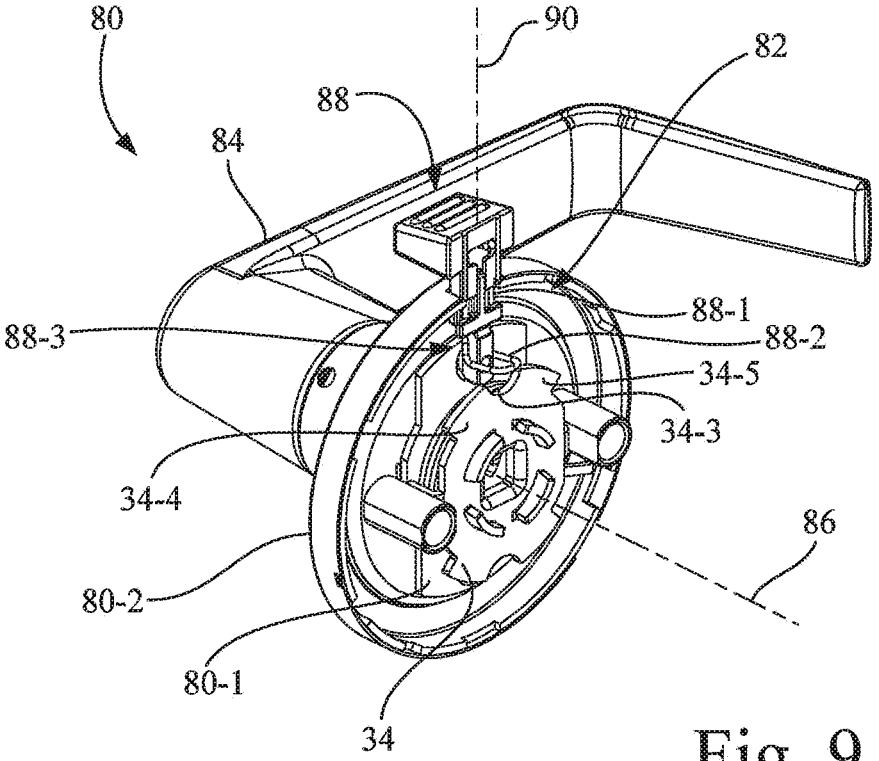
FIG. 9 is an inner perspective view of an interior handle assembly having another alternative supplemental lock, with the actuator in the non-blocking position.
Figure 10:
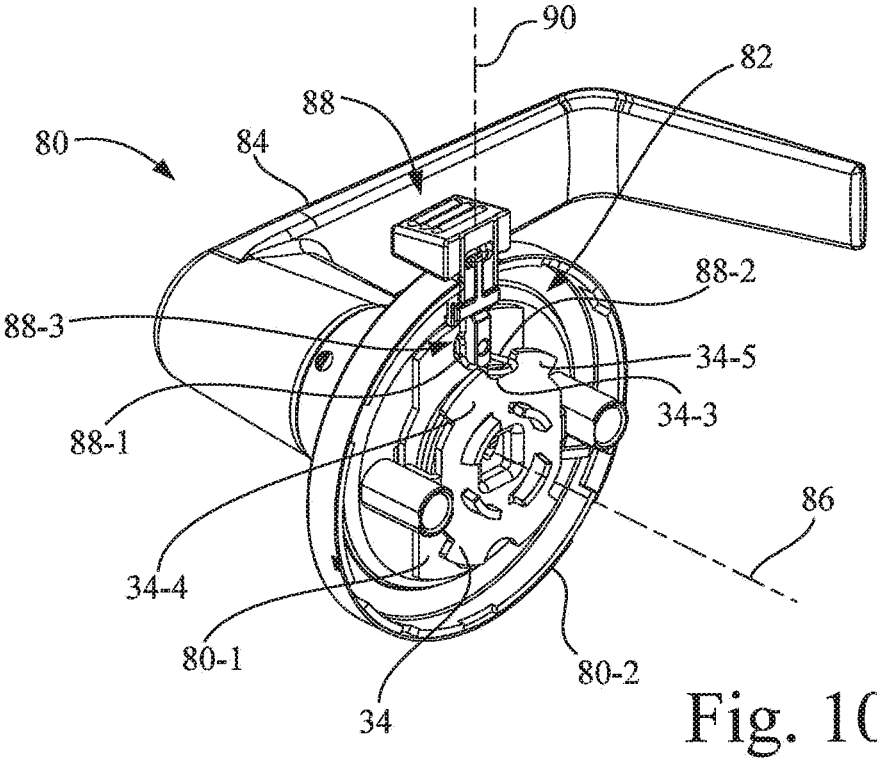
FIG. 10 is a perspective view corresponding to FIG. 9, but with the actuator in the blocking position.

FIGS. 9 and 10 depict another embodiment of the invention, which utilizes first rotation plate 34, as also depicted in FIGS. 4 and 5. The present embodiment of FIGS. 9 and 10 differs from the embodiment of FIGS. 1-6, in significant part, by using an orthogonal translation motion of an actuator to selectively block and unblock rotation plate 34 from rotation, rather than by using rotary motion.

In particular, the present alternative embodiment includes an interior handle assembly 80, and includes a supplemental lock 82 that is supplemental to primary lock 20 (not shown; see, e.g., FIG. 2). Interior handle assembly 80 is configured for coupling to latch bolt assembly 18 via latch spindle 28 as in the prior embodiment (not shown; see, e.g., FIG. 3).

Also, supplemental lock 82 includes rotation plate 34, described above, connected to latch spindle 28.

Interior handle assembly 80 includes an interior chassis 80-1, an interior escutcheon 80-2, and an interior handle 84, e.g., a lever. Interior handle 84 is rotatably coupled to an interior chassis 80-1, and is positioned to rotate about a primary rotational axis 86. Interior handle 84 is coupled to latch spindle 28 for rotation in unison therewith. A rotation of interior handle 84 results in a linear translation of latch bolt 18-2 via a corresponding rotation of latch spindle 28.

Supplemental lock 82 includes an interior actuator 88, which is in the form of a slider, and which is configured to translate linearly along a secondary translation axis 90. Interior actuator 88 is slidably coupled to interior chassis 80-1 and/or interior escutcheon 80-2 for linear translation along the secondary translation axis. Secondary translation axis 90 is substantially orthogonal to primary rotational axis 86, and is positioned to intersect primary rotational axis 86.

Interior actuator 88 includes a projecting portion 88-1 that translates along secondary translation axis 90, and projects downwardly through a slot in interior escutcheon 80-2. Projecting portion 88-1 includes an engagement portion 88-2 and a detent portion 88-3. Engagement portion 88-2 extends inwardly away from interior handle 84, and may be oriented to extend parallel to primary rotational axis 86, so as to selectively engage radially inwardly facing notch 34-3 of rotation plate 34 when projecting portion 88-1 is moved downwardly to the blocking position.

Projecting portion 88-1 may be formed as an L-shaped wire structure having a vertical portion and a horizontal portion, wherein the engagement portion 88-2 is the horizontal portion and extends substantially parallel to primary rotational axis 86.

Detent portion 88-3 of interior actuator 88 is in the form of at least one offset in projecting portion 88-1. The offset forms a bump that axially contacts a side wall of interior chassis 80-1 when projecting portion 88-1 is translated downwardly toward the blocking position. The bump may be in the form of a V-bend in the vertical portion of the wire structure of projecting portion 88-1, with the apex of the bump facing in a direction toward interior chassis 80-1.

FIG. 9 shows supplemental lock 82 in a non-blocking position, wherein interior actuator 88 and projecting portion 88-1 are raised along secondary translation axis 90, so as to disengage engagement portion 88-2 from radially inwardly facing notch 34-3 of rotation plate 34, and with detent portion 88-3 contacting an upper edge of interior chassis 80-1. In the non-blocking position, projecting portion 88-1 is in a non-deflected, e.g., vertical, position.

FIG. 10 shows supplemental lock 82 in a blocking position, wherein interior actuator 88 and projecting portion 88-1 are lowered along secondary translation axis 90, such that engagement portion 88-2 is engaged with radially inwardly facing notch 34-3 of rotation plate 34, and with the apex of the bump of projecting portion 88-1 contacting a side wall of interior chassis 80-1 to apply a lateral force against the side wall of interior chassis 80-1. In the blocking position, projecting portion 88-1 deflects laterally due to the engagement of the bump with the side wall of the interior chassis 80-1 to generate the lateral force, with the deflection being in an opposite direction to the direction of the lateral force.

In an emergency situation, if enough force is applied to interior handle 84, then projecting rod projecting portion 88-1 will be deformed or deflected, e.g., by rotation plate 34, thereby allowing free rotation of interior handle 84 and in turn, the rotation of latch spindle 28 to operate latch bolt assembly 18 via the rotation of interior handle 84.

As used herein, including the claims, the terms "parallel" and "orthogonal" are intended to include slight variations associated with normal manufacturing tolerances, and unless otherwise stated, includes a variation of plus or minus 0.5 degrees. The term "substantially horizontal" means a range of horizontal, plus or minus three degrees. The term "substantially parallel" means a range of parallel, plus or minus three degrees. The term "substantially orthogonal" means a range of orthogonal, plus or minus three degrees.

While this invention has been described with respect to multiple embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A door handle set, comprising:

a handle assembly having a primary lock and having a handle rotatable about a primary rotational axis;

a latch bolt assembly having a latch bolt, the latch bolt assembly being operatively coupled to the handle assembly, wherein a rotation of the handle results in a linear translation of the latch bolt;

a supplemental lock having a second axis parallel to, and spaced apart from, the primary rotational axis, the supplemental lock having an actuator that is operable relative to the second axis, wherein the supplemental lock is configured to selectively block the rotation of the handle regardless of the locking state of the primary lock, the supplemental lock further including a rotation rod having a first rotational position and a second rotational position; and a detent engaged with the rotation rod of the supplemental lock to bias the rotation rod to the first rotational position.

2. The door handle set of claim 1, wherein the primary lock is arranged along the primary rotational axis.

3. The door handle set of claim 1, wherein the actuator of the supplemental lock is positioned to be obscured by the handle when viewed at an angle that originates below the primary rotational axis.

4. The door handle set of claim 1, wherein:

the latch bolt assembly has a latch bolt drive configured to rotate to cause a translation of the latch bolt;

a latch spindle is coupled to each of the handle and the latch bolt drive of the latch bolt assembly, such that a rotation of the handle about the primary rotational axis operates the latch bolt; and the supplemental lock includes:

a rotation plate connected to the latch spindle, and the rotation rod coupled to the actuator, the rotation rod configured to rotate about the second axis, the rotation rod configured to selectively block the rotation plate and latch spindle from rotation.

5. The door handle set of claim 4, wherein each of the latch spindle and the rotation plate are arranged on the primary rotational axis.

6. The door handle set of claim 4, wherein:

the rotation plate has an outer perimeter that defines a radially inwardly facing notch interposed between a pair of locking projections, the inwardly facing notch being sized and positioned to accommodate a diameter of the rotation rod; and the rotation rod has an outer radial slot that extends partway into the rotation rod, the outer radial slot being axially positioned along the second axis to radially accommodate the rotation plate.

7. The door handle set of claim 6, wherein:

when the outer radial slot of the rotation rod is in a non-blocking position, the outer radial slot is rotatably positioned to accommodate the pair of locking projections of the rotation plate such that the handle is not impeded from rotation about the primary rotational axis; and when the rotation rod is rotated to a blocking position, the outer radial slot of the rotation rod is positioned such that at least one of the pair of locking projections of the rotation plate will engage the rotation rod so as to block rotation of the rotation plate and the handle, and in turn impede retraction of the latch bolt.

8. The door handle set of claim 4, further comprising the detent having a spring member configured to exert a radial force on the rotation rod.

9. The door handle set of claim 8, wherein:

the handle assembly has a handle chassis;

the rotation rod has a detent groove; and the spring member is a wire spring having an engagement portion and two free end portions, the two free end portions being respectively connected to the handle chassis, the engagement portion of the spring member being positioned to be in radial alignment with the detent groove so as to engage the detent groove when the detent groove of the rotation rod is rotated to facilitate engagement with the spring member.

10. The door handle set of claim 1, wherein:

the handle assembly includes an escutcheon having a hole, wherein in a first orientation of the escutcheon the hole is aligned with the second axis; and wherein the actuator is slidably coupled to the handle, the actuator configured for linear movement along the second axis, the actuator having a projecting rod configured to extend into the hole of the escutcheon, so as to block a rotation of the handle.

11. The door handle set of claim 10, the actuator is configured to linearly move in a direction away from the escutcheon to unblock the rotation of the handle.

12. The door handle set of claim 10, further comprising a spring member configured to bias the actuator toward the escutcheon.

13. The door handle set of claim 10, wherein in a second orientation of the escutcheon, the hole of the escutcheon is not aligned with the second axis, such that the projecting rod of the actuator is no longer aligned with the hole in the escutcheon so as to disable the supplemental lock.

14. The door handle set of claim 1, wherein the detent is directly engaged with the rotation rod of the supplemental lock.

15. A door handle set, comprising:

a handle assembly having a primary lock and having a handle rotatable about a primary rotational axis;

a latch bolt assembly having a latch bolt, the latch bolt assembly being operatively coupled to the handle assembly, wherein a rotation of the handle results in a linear translation of the latch bolt;

a supplemental lock having a second axis parallel to, and spaced apart from, the primary rotational axis, the supplemental lock having an actuator that is operable relative to the second axis, wherein the supplemental lock is configured to selectively block the rotation of the handle regardless of the locking state of the primary lock; and a detent directly engaged with a rotation rod of the supplemental lock to provide resistance to the rotation of the actuator of the supplemental lock.

16. The door handle set of claim 15, wherein the actuator of the supplemental lock is positioned to be obscured by the handle when viewed at an angle that originates below the primary rotational axis.

17. The door handle set of claim 15, wherein:

the latch bolt assembly has a latch bolt drive configured to rotate to cause a translation of the latch bolt;

a latch spindle is coupled to each of the handle and the latch bolt drive of the latch bolt assembly, such that a rotation of the handle about the primary rotational axis operates the latch bolt; and the supplemental lock includes:

a rotation plate connected to the latch spindle, and the rotation rod coupled to the actuator, the rotation rod configured to rotate about the second axis, the rotation rod configured to selectively block the rotation plate and latch spindle from rotation.

18. The door handle set of claim 17, wherein each of the latch spindle and the rotation plate are arranged on the primary rotational axis.

19. The door handle set of claim 17, wherein:

the rotation plate has an outer perimeter that defines a radially inwardly facing notch interposed between a pair of locking projections, the inwardly facing notch being sized and positioned to accommodate a diameter of the rotation rod; and the rotation rod has an outer radial slot that extends partway into the rotation rod, the outer radial slot being axially positioned along the second axis to radially accommodate the rotation plate.

20. The door handle set of claim 19, wherein:

when the outer radial slot of the rotation rod is in a non-blocking position, the outer radial slot is rotatably positioned to accommodate the pair of locking projections of the rotation plate such that the handle is not impeded from rotation about the primary rotational axis; and when the rotation rod is rotated to a blocking position, the outer radial slot of the rotation rod is positioned such that at least one of the pair of locking projections of the rotation plate will engage the rotation rod so as to block rotation of the rotation plate and the handle, and in turn impede retraction of the latch bolt.

* * * * *